US007604124B1

(12) United States Patent
Shingle

(10) Patent No.: US 7,604,124 B1
(45) Date of Patent: Oct. 20, 2009

(54) DISPENSING CONTAINER AND PACKAGE FOR PELLETIZED PRODUCTS

(75) Inventor: John M. Shingle, Perrysburg, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 85 days.

(21) Appl. No.: 11/818,323

(22) Filed: Jun. 14, 2007

(51) Int. Cl.
*B65D 85/42* (2006.01)
*A47G 19/00* (2006.01)

(52) U.S. Cl. ..... 206/534; 206/535; 206/828; 220/23.83

(58) Field of Classification Search ..... 206/534, 206/530, 528, 535–537, 828; 220/4.27, 23.2, 220/23.4, 23.83, 23.86
See application file for complete search history.

(56) References Cited

U.S. PATENT DOCUMENTS

| | | | | | |
|---|---|---|---|---|---|
| 3,003,273 | A | * | 10/1961 | Tapper | 40/307 |
| 3,042,257 | A | | 7/1962 | Dailey | |
| 3,306,493 | A | | 2/1967 | Szajna | |
| 3,365,099 | A | * | 1/1968 | McTagggart | 221/267 |
| 3,366,265 | A | * | 1/1968 | Hesselbarth | 220/23.4 |
| 3,382,969 | A | | 5/1968 | Cemiak | |
| 3,481,513 | A | | 12/1969 | Ram | |
| 3,527,383 | A | | 9/1970 | Borsum et al. | |
| 3,768,636 | A | | 10/1973 | O'Connell, Jr. | |
| D236,585 | S | * | 9/1975 | Toledo | D9/740 |
| 4,127,190 | A | | 11/1978 | Sunnen | |
| 4,133,445 | A | | 1/1979 | Mandelbaum | |
| 4,150,766 | A | | 4/1979 | Westendorf et al. | |
| 4,202,643 | A | | 5/1980 | Backteman | |
| 4,485,932 | A | * | 12/1984 | Kusz | 215/222 |
| 4,807,757 | A | * | 2/1989 | Rappaport et al. | 206/535 |
| 4,819,820 | A | | 4/1989 | Weiner | |
| 4,905,866 | A | * | 3/1990 | Bartell et al. | 221/5 |
| 4,984,709 | A | * | 1/1991 | Weinstein | 221/7 |
| 5,979,698 | A | * | 11/1999 | Deal | 221/2 |
| 6,343,695 | B1 | * | 2/2002 | Petrick et al. | 206/534 |
| 6,796,267 | B2 | * | 9/2004 | DuBarry | 116/308 |
| 6,860,513 | B2 | | 3/2005 | Kaufman | |
| 2004/0262308 | A1 | | 12/2004 | Hase | |
| 2005/0218031 | A1 | | 10/2005 | Murphy | |
| 2006/0086640 | A1 | * | 4/2006 | Luciano et al. | 206/534 |
| 2006/0169621 | A1 | * | 8/2006 | Rulifson | 206/534 |

FOREIGN PATENT DOCUMENTS

| | | |
|---|---|---|
| DE | 1124420 | 1/1960 |
| WO | WO 03/059785 | 7/2003 |

* cited by examiner

*Primary Examiner*—Ehud Gartenberg
*Assistant Examiner*—Jose S Stephens, III
(74) *Attorney, Agent, or Firm*—Reising Ethington P.C.

(57) ABSTRACT

A container for storing and dispensing pelletized products includes an elongate hollow tube, an exterior panel integrally tangentially extending from the tube and dosage period indicia on the panel adjacent to the tube. Spacings between the dosage period indicia on the panel preferably are coordinated with a predetermined size of the pelletized products within the tube such that a dosage period indicium is disposed adjacent to each pelletized product in the tube when the tube is full. The dosage period indicia can be molded, printed or labeled on the panel. The dosage period indicia preferably are days of the week, and multiple containers, preferably four containers, can be assembled in a package for sale to a consumer.

17 Claims, 3 Drawing Sheets

DISPENSING CONTAINER AND PACKAGE FOR PELLETIZED PRODUCTS

The present disclosure relates to containers and packages for dispensing pelletized products such as medication tablets and pills.

BACKGROUND AND SUMMARY OF THE DISCLOSURE

A general object of the present disclosure is to provide a container and a package for storing and dispensing pelletized products such as medication tablets or pills, within which the pelletized products can be marketed to a consumer and which aids the consumer in complying with a dosage regimen associated with the products.

The present disclosure embodies a number of aspects that can be implemented separately from or in combination with each other.

A container for storing and dispensing pelletized products, in accordance with one aspect of the present disclosure, includes an elongate hollow tube, an exterior panel integrally tangentially extending from the tube and dosage period indicia on the panel adjacent to the tube. Spacings between the dosage period indicia on the panel preferably are coordinated with a predetermined size of the pelletized products within the tube such that a dosage period indicium is disposed adjacent to each pelletized product in the tube when the tube is full. The dosage period indicia can be molded, printed or labeled on the panel. The dosage period indicia preferably are days of the week, and multiple containers, preferably four containers, can be assembled in a package for sale to a consumer.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
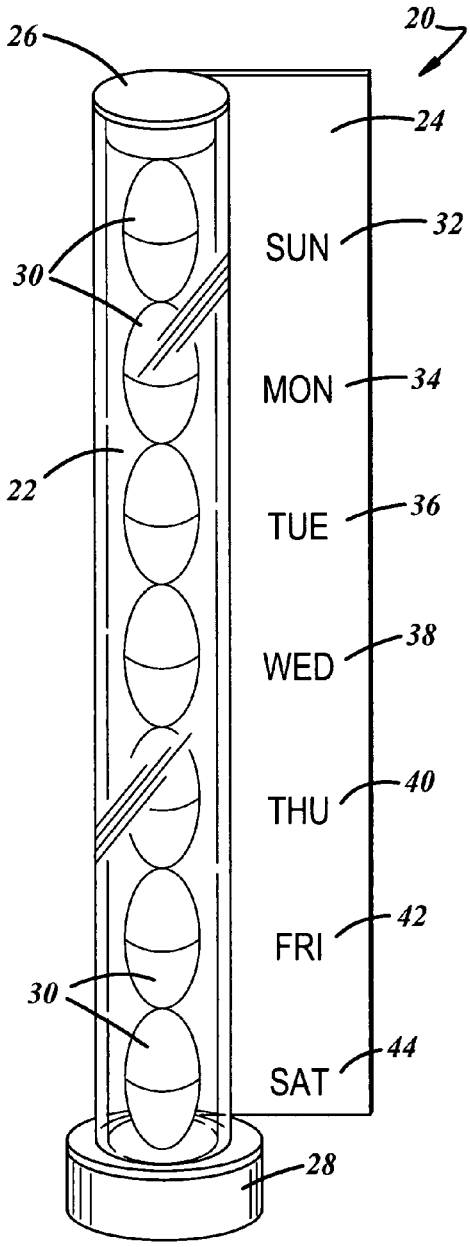
FIG. 1 is a perspective view of a container for storing and dispensing pelletized products in accordance with an exemplary embodiment of the present disclosure.

FIG. 1 illustrates a container 20 in accordance with an exemplary embodiment of the present disclosure as including an elongate hollow tube 22 and a flat panel 24 integrally tangentially extending from tube 22—i.e., tangentially of the axis of the tube. Tube 22 in the embodiment of FIG. 1 is cylindrical, and preferably is of translucent plastic construction such that pelletized products 30 within the tube can be viewed through the wall of the tube. One end of the tube is closed, preferably permanently closed, such as by a cap 26. As an alternative, the end of the tube can be closed as molded. The other end of the tube is closed by a removable closure 28. Closure 28 preferably is a child-resistant closure, such as illustrated for example in U.S. Pat. No. 4,057,159, 4,059,198 or 4,485,932.

Pelletized products in the form of pills 30 are illustrated in FIG. 1 and can substantially fill the length of the tube. These pelletized products preferably are of predetermined size. Dosage period indicia 32-44 are provided on panel 24 adjacent to tube 22. The spacings between dosage period indicia 32-44 preferably are coordinated with the predetermined size of the pelletized products 30 so that a dosage period indicium is disposed adjacent to each pelletized product in the tube when the tube is full, as illustrated in FIG. 1. In the various embodiments disclosed in the present application, the dosage period indicia 32-44 comprise days of the week, Sunday through Saturday in FIGS. 1-3 (and Monday through Sunday in FIGS. 4-8). Other dosage indicia can be employed.

Figure 2:
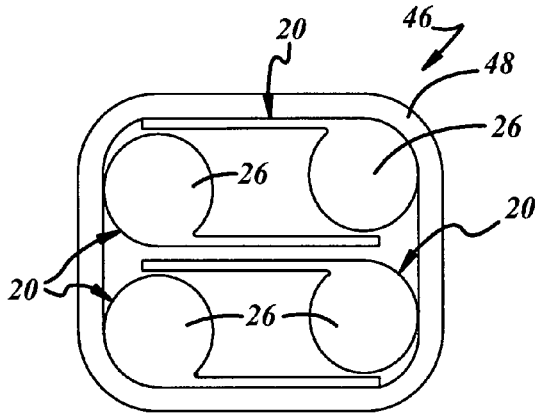
FIG. 2 is a top plan view of four of the containers of FIG. 1 packaged for sale to a consumer.

FIG. 2 illustrates a package 46 of four containers 20 enclosed by a suitable wrap 48. Wrap 48 can include suitable prescription or other information. A consumer that purchases package 46 can remove wrap 48 to obtain access to products 30 sufficient for four weeks. To obtain access to products 30, closure 28 is removed from the end of tube 22 and a single product is removed. Closure 28 can be disposed at the bottom end of the container. The dosage period indicia 32-44 preferably are disposed chronologically from top to bottom of the tube so that the next dosage period is disposed adjacent to the top-most product 30 when the container is held vertically as illustrated in FIG. 1. The removable closure 28 alternatively can be disposed at the top end of the container, as illustrated in FIGS. 4 and 6.

Figure 3:
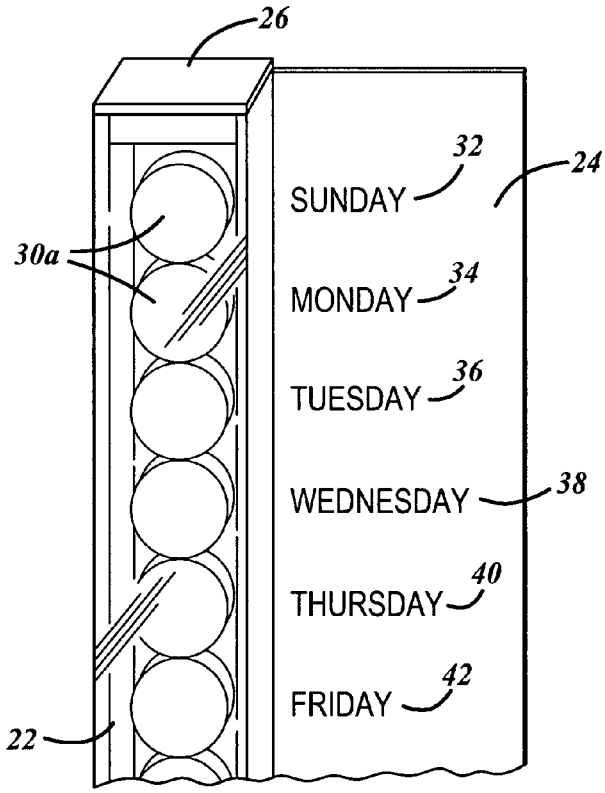
FIG. 3 is a fragmentary perspective view of a modified embodiment of the container illustrated in FIG. 1.

Dosage period indicia 32-44 can be molded onto panel 24, such as by raised or recessed molding, can be printed on the panel after molding, or can be printed on a separate label that is secured to the panel after molding. The last alternative is particularly useful in situations where a particular tube and panel construction is suitable for dispensing pelletized products of different sizes. A dosage indicia label can be selected in association with the size of the products placed in the adjacent tube. Each tube and associated panel preferably is of integrally molded plastic construction, most preferably translucent plastic construction as previously indicated. The cross-sectional geometry of tube 22 preferably is selected in coordination with the cross-sectional geometry of the products to be disposed in the tube. Thus, a cylindrical tube geometry is illustrated in FIGS. 1 and 2 associated with the circular cross-section of pill products 30. FIG. 3 shows a modification in which the cross-sectional geometry of tube 22 is rectangular (including square) in association with the generally rectangular cross-sectional geometry of tablet-shaped products 32*a* disposed within the tube.

Figure 4:
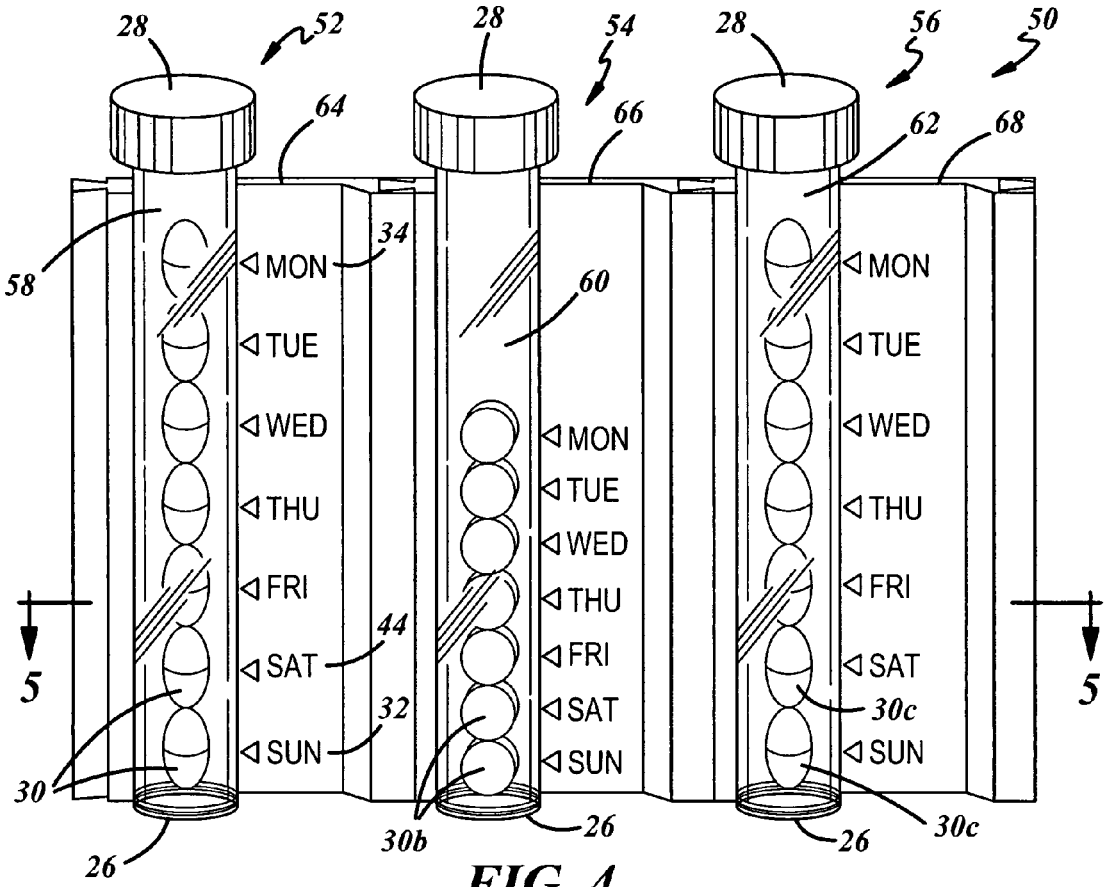
FIG. 4 is a perspective view of a package that includes three containers in accordance with another exemplary embodiment of the present disclosure.
Figure 5:
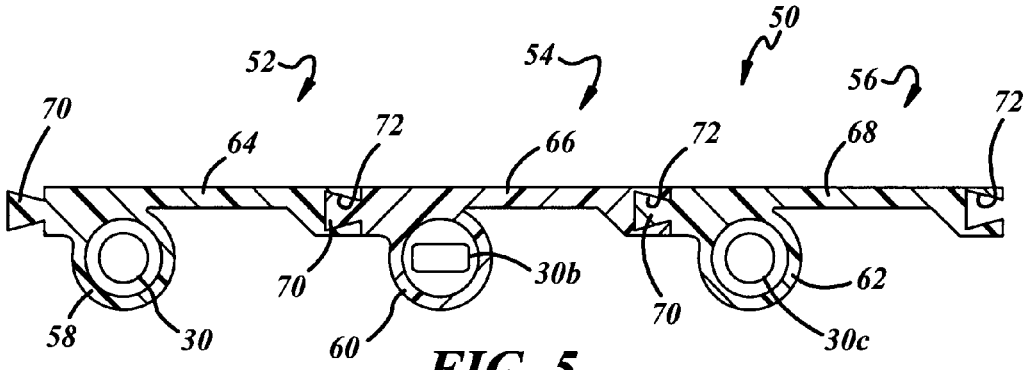
FIG. 5 is a sectional view taken substantially along the line 5-5 in FIG. 4.

FIGS. 4 and 5 illustrate a package 50 in accordance with another exemplary embodiment of the present disclosure. Package 50 may include, for example, three containers 52,54, 56. Each container includes an associated hollow tube 58, 60, 62 having an integral flat tangential panel 64,66,68. Indicia 32-44 are provided on each panel adjacent to the associated tube, with the spacings between the indicia being associated with the predetermined geometry of the products disposed within the respective tubes. Thus, in this example, container 54 has smaller tablet-shaped products 32*b*, so that the indicia on panel 66 are closer together than are the indicia on panels 64 and 68 in this example. Each panel 64,66,68 has side edges that are parallel to each other and preferably parallel to the axis of the associated tube 58,60,62. Each panel has a tongue 70 extending along one side edge of the panel, preferably the left side edge closest to the associated tube in FIG. 5, and a groove 72 extending along the opposing side edge of the panel. The geometries of tongues 70, which preferably are identical, are coordinated with the geometries of grooves 72, which again preferably are identical, so that the panels can be slidably assembled to each other in a flat array as illustrated in FIG. 5 to form package 50. Package 50 is particularly suitable when a consumer is to take a number of different medications on a periodic basis, such as a daily basis. Different medication products 30,30*b*,30*c* can be placed in containers 52,54,56 and taken by the consumer/patient at the appropriate dosage intervals indicated by indicia 32-44. While three containers 52,54, 56 are illustrated, package 50 could as easily include two containers, or four or more containers.

Figure 6:
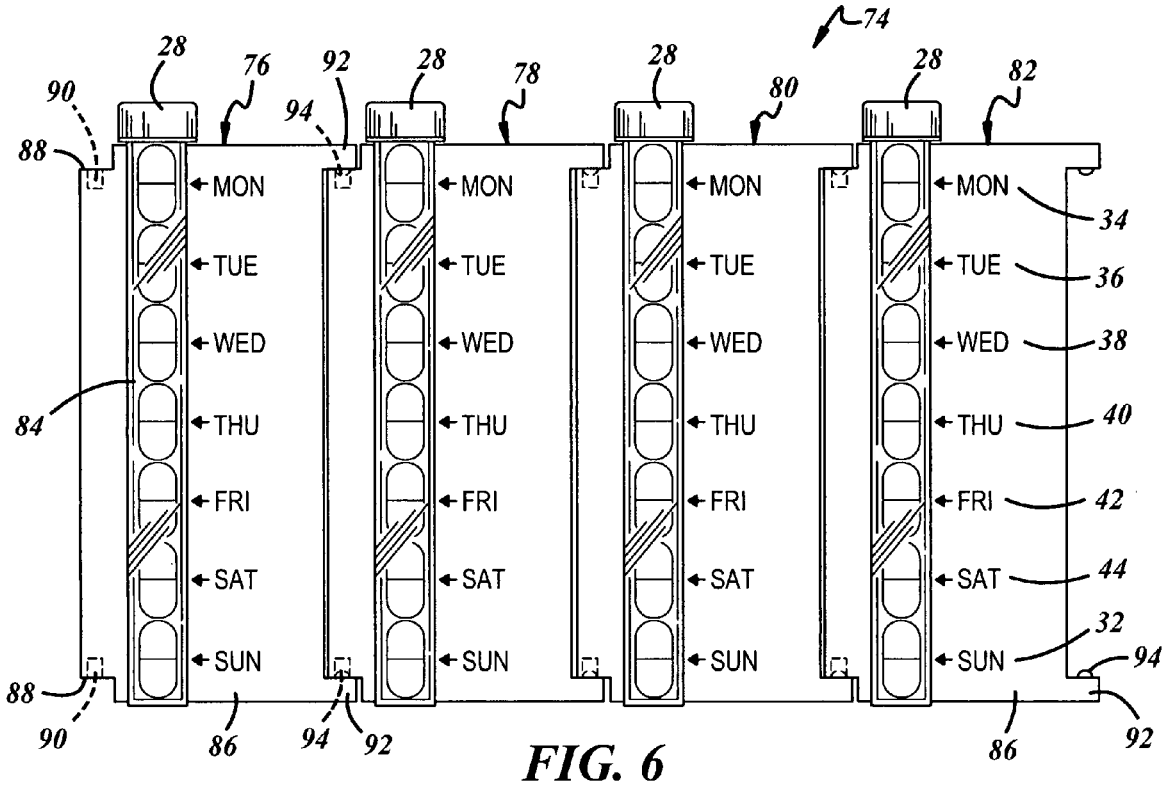
FIG. 6 is an elevational view of a package that includes four containers in accordance with a further exemplary embodiment of the present disclosure.
Figure 7:
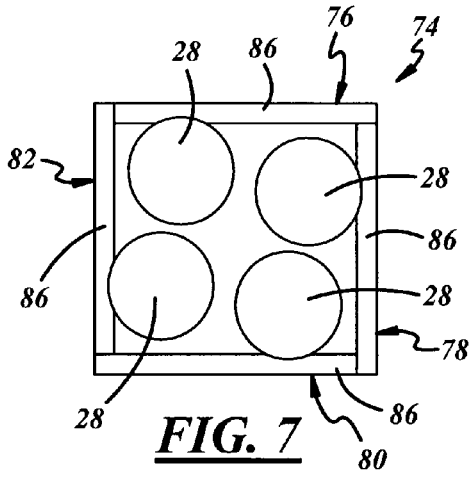
FIG. 7 is a top plan view of the package in FIG. 6 configured for sale to a consumer.
Figure 8:
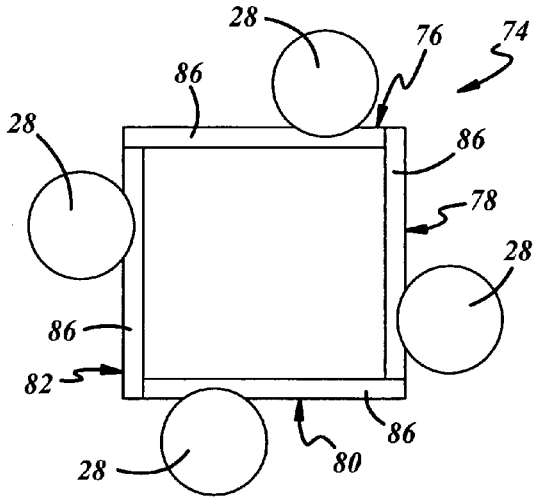
FIG. 8 is a top plan view of the package in FIGS. 6 and 7 configured for use.

FIGS. 6-8 illustrate a package 74, in accordance with yet another exemplary embodiment of the present disclosure, as including four containers 76,78,80,82. In the example shown, the four containers are identical. Each container includes an elongate hollow tube 84 and an integral flat tangential panel 86 with associated indicia 32-44 as previously described. The bottom ends of the tubes 84 in FIG. 6 are molded closed, while removable closures 28, preferably child-resistant closures, are assembled to the upper ends of the tubes. Panel 86 of container 76 has one edge with recessed ends 88 and pockets 90 opening outwardly, preferably aligned with each other along an axis parallel to the axis of tube 84. The opposing edge of panel 86 has outwardly extending legs 92 with opposed inwardly projecting pins 94. Pins 94 are aligned with each other along an axis parallel to the axis of tube 84. Legs 92 can be received within recessed ends 88 of the adjacent panel 86 and pins 94 received by snap-fit within pockets 90 so that each panel 86 is pivotable with respect to the adjacent panel. A package 74 of four containers 76-82 is particularly advantageous in that the four panels can be pivoted so that tubes 84 are disposed within a rectangular periphery defined by the panels, as shown in FIG. 7, for shipment and/or marketing to a consumer. Suitable label information can be wrapped around panels 86 to provide information to the consumer. When product is to be dispensed, two of the adjacent panels can be disengaged and the panels pivoted to the geometry illustrated in FIG. 8, at which the tubes 84 are oriented outwardly to facilitate viewing of the dosage indicia and the products within the tubes. Package 74 is particularly useful for dispensing four weeks worth of identical products.

There thus has been disclosed a container and a package for storing and dispensing pelletized products that fully satisfy all of the objects and aims previously set forth. The container and package have been disclosed in conjunction with several exemplary embodiments, and modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A container for storing and dispensing pelletized products of predetermined size, which includes an elongate hollow tube of translucent plastic construction such that pelletized products within said tube can be viewed through said tube, an exterior panel integrally tangentially extending from said tube, and dosage period indicia on said panel adjacent to said tube, wherein spacings between said dosage period indicia on said panel are coordinated with the predetermined size of said pelletized products such that a dosage period indicium is disposed adjacent to each pelletized product in said tube and said dosage period indicia on said panel are disposed chronologically from top to bottom so that a next dosage period is disposed adjacent to the top-most pelletized product when the container is vertically oriented, wherein said panel has side edges parallel to said tube, first securement means at one side edge of said panel and second securement means complimentary to said first securement means at an opposing side edge of said panel such that said panels can be secured to each other edge-to-edge to form a multiple-container package.

2. The container set forth in claim 1 including a removable closure on an end of said tube for dispensing products from within said tube.

3. The container set forth in claim 2 wherein said removable closure is a child-resistant closure.

4. The container set forth in claim 2 wherein said tube has a permanently closed end spaced from said removable closure.

5. The container set forth in claim 1 wherein said indicia are molded, printed or labeled on said panel.

6. The container set forth in claim 5 wherein said dosage period indicia are days of the week.

7. The container set forth in claim 6 in a package that includes four of said containers.

8. The container set forth in claim 1 wherein said tube is cylindrical or rectangular.

9. The container set forth in claim 1 wherein said first and second securement means comprise tongue and groove securement means.

10. The container set forth in claim 1 wherein said first and second securement means comprise pivotal securement means such that a package that includes multiple containers can be placed in a first configuration with said panels interconnected to form a closed interior volume and said tubes disposed within said closed interior volume, and in a second configuration with said panels forming a closed interior volume and said tubes disposed outside of said closed interior volume.

11. A package that includes:

at least two containers for storing and dispensing pelletized products of predetermined size, each of said containers having an elongate hollow tube and a flat panel integrally tangentially extending from said tube, and being of integrally molded translucent plastic construction such that the pelletized products within said tube can be viewed through said tube, and dosage period indicia on said panel adjacent to said tube wherein spacings between said dosage period indicia on said panel are coordinated with the predetermined size of said pelletized products such that a dosage period indicium is disposed adjacent to each pelletized product in said tube and said dosage period indicia on said panel and disposed chronologically from top to bottom so that a next dosage period is disposed adjacent to the top-most pelletized product when the container is vertically oriented, and a removable closure on an end of said tube for dispensing product from within said tube, wherein each said panel has side edges parallel to the associated tube, first securement means at one side edge of said panel and second securement means complementary to said first securement means and at an opposing side edge of said panel, said panels being secured to each other by means of said first and second securement means.

12. The package set forth in claim 11 wherein said first and second securement means comprise tongue and groove securement means, with each said panel having a groove extending along one side edge of said panel and a tongue extending along an opposing side edge of said panel and slidably receivable in the groove of the adjacent panel.

13. The package set forth in claim 11 wherein said first and second securement means comprise pivotal securement means such that said package is adapted to be placed in a first configuration with said panels interconnected to form a closed interior volume and said tubes disposed within said closed interior volume, and in a second configuration with said panels forming a closed interior volume and said tubes disposed outside of said closed interior volume.

14. The package set forth in claim 11 wherein said removable closure is child-resistant closure.

15. The package set forth in claim 11 wherein said dosage period indicia are days of the week.

16. The package set forth in claim 15 wherein said package includes four of said containers.

17. The package set forth in claim 11 wherein said tubes are of cylindrical or rectangular construction.

* * * * *